United States Patent [19]

Foster et al.

[11] Patent Number: 4,475,887

[45] Date of Patent: Oct. 9, 1984

[54] LAVATORY SETTER

[75] Inventors: Bryan D. Foster, Holden, Mass.; Del G. Stapleton, Marietta, Ga.

[73] Assignee: Norton Company, Worcester, Mass.

[21] Appl. No.: 496,170

[22] Filed: May 19, 1983

[51] Int. Cl.[3] ..... F27D 5/00

[52] U.S. Cl. ..... 432/258; 264/57; 432/5; 432/6; 432/253

[58] Field of Search ..... 432/258, 5, 259, 6, 432/253; 264/57-59

[56] References Cited

U.S. PATENT DOCUMENTS

| | | | |
|---|---|---|---|
| 1,546,382 | 7/1925 | Higgins | 432/258 |
| 2,039,172 | 4/1936 | Lemmerman | 264/57 |
| 2,233,434 | 3/1941 | Smith | 432/258 |
| 2,314,534 | 3/1943 | Wind | 432/258 |
| 3,948,594 | 4/1976 | Irwin, Jr. | 432/259 |
| 4,016,313 | 4/1977 | Schrewelius | 428/35 |
| 4,330,269 | 5/1982 | Chu | 432/258 |

FOREIGN PATENT DOCUMENTS

| | | | |
|---|---|---|---|
| 319490 | 2/1957 | France | 432/258 |

*Primary Examiner*—Henry C. Yuen

*Attorney, Agent, or Firm*—Walter Fred

[57] ABSTRACT

A hollow lavatory setter (10, 10', 10'', 10''') of recrystallized silicon carbide has a continuous wall of predetermined cross sectional size and shape including an outer wall portion (14, 14', 14'', 14''') spaced from a bowl engaging inner wall portion (16, 16', 16'', 16''') adjoining, extending around and defining the general configuration of a bowl receiving opening (18, 18', 18'', 18''') and the peripheral mounting rim portion (R', R''') including a continuous mounting under surface of a rimless lavatory (L', L'''). Spaced upper (24, 24', 24'', 24''') and lower (26, 26', 26'', 26''') wall portions extend between the inner and outer wall portions and of which the upper wall (24, 24', 24'', 24''') surface is adapted to supportingly engage and maintain the continuous mounting under surface of the peripheral mounting rim portion (R, R''') in a single plane during firing in a kiln and suitable for mounting on a counter top thereafter.

11 Claims, 5 Drawing Figures

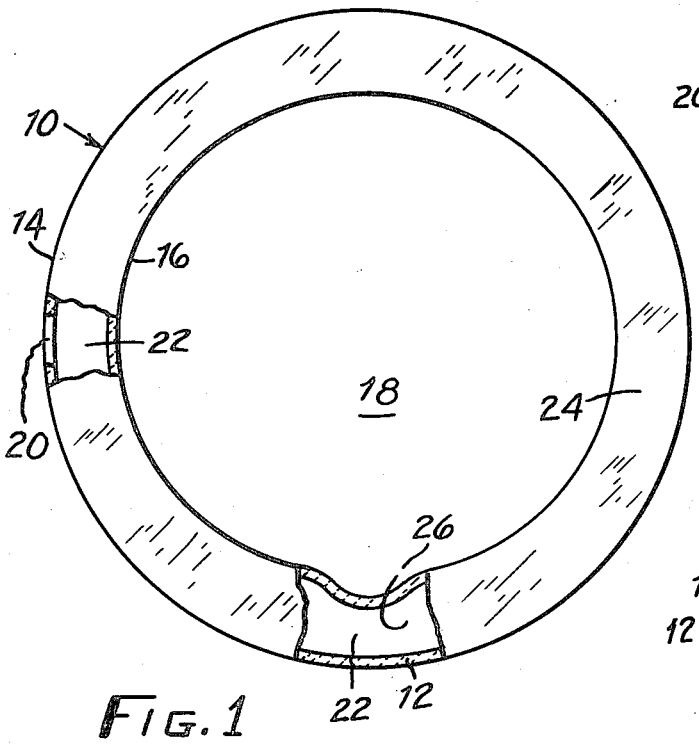
FIG. 1
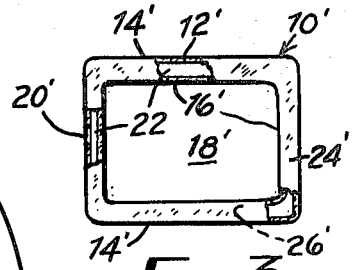
FIG. 3
FIG. 4
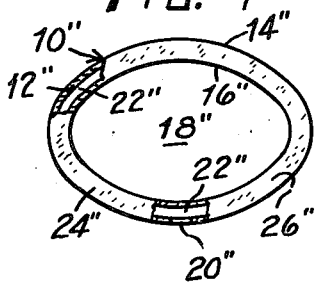
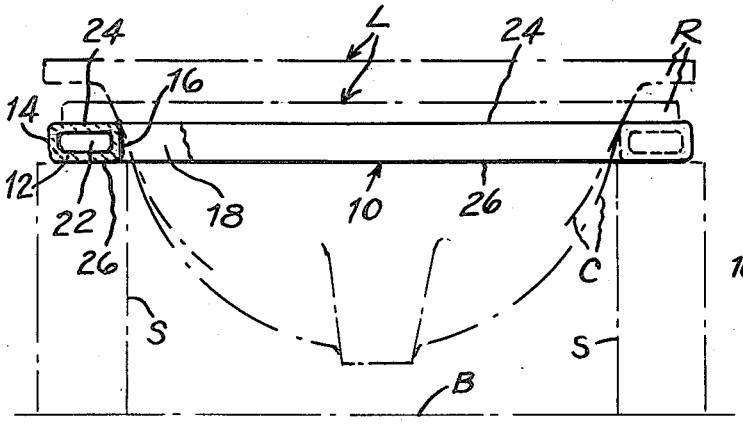
FIG. 2
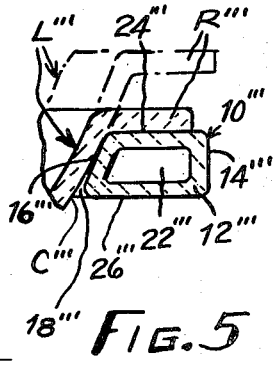
FIG. 5

LAVATORY SETTER

TECHNICAL DISCLOSURE

A stable hollow, low mass recrystallized silicon carbide kiln setter of longer life for rimless lavatories of predetermined configuration is supported in a raised position on refractory support blocks or stringers and has an upper flat support surface which engages and maintains the under mounting surface of the lavatory rim portion in substantially a single horizontal plane and thus provides a flat surface for mounting on a counter top.

BACKGROUND OF THE INVENTION

1. Field of the Invention

The invention relates to refractory kiln furniture for firing ceramic sanitary ware in a kiln and particularly to a hollow stable setter for supporting and firing a rimless or self-rimming lavatory.

2. Description of the Prior Art

Heretofore, rimless ceramic lavatories of various shape were fired by supporting them on a solid refractory plate having an opening therein of the desired configuration adapted to receive the bowl portion of the lavatory and supported in a raised portion by refractory members.

Others have been supported in a raised position by resting the rim on the upper surface of a number of blocks arranged around the bowl portion of the rimless lavatory.

However, in addition to having a short life span, those prior art means were not entirely satisfactory as the under mounting surface of the rim portion became irregular and did not remain continuously in a single horizontal plane during firing due to the fact that the solid support plate warped and the support blocks around the bowl did not engage the entire undersurface.

Thus, the uneven rough undersurface of the rimless lavatory often needed to be ground straight and flat before it was suitable for mounting on a counter top.

The hollow thin walled low weight setter of the instant invention has solved the above problems due to the fact that it is much more dependable and stable, and can be molded or slip cast and fired to provide smooth support engaging surfaces of precise size and shape. Thus, the smooth support surfaces allow free downward movement, provides and maintains a continuous under mounting surface of the lavatory rim in a single plane during firing and shrinkage of the rimless lavatory in a kiln. It also has longer life, requires fewer supports and hence, increases the available room and capacity of the kiln car.

SUMMARY OF THE INVENTION

A hollow stable low mass recrystallized silicon carbide lavatory setter of longer life and continuous hollow substantially rectangular cross section and predetermined circular, oval, square, or rectangular configuration is disclosed. The setter comprises an inner wall including an inner inclined surface and/or an upper inner convex corner surface extending around a lavatory bowl receiving opening and adapted for supporting engagement with a convex surface portion of the bowl adjoining the rim of the lavatory. A continuous upper surface of the setter is adapted to supportingly engage and maintain the continuous mating under mounting surface of the rim portion of predetermined configuration in a single plane during firing and shrinkage of the rimless lavatory in a kiln.

BRIEF DESCRIPTION OF THE DRAWING

FIG. 1 is a top view of a circular lavatory setter according to the invention;

FIG. 2 is a front view partly in section of the lavatory setter of FIG. 1 provided with an upper inner convex corner portion and supporting a rimless lavatory, both supported in a raised position by refractory members as shown in phantom lines;

FIG. 3 is a top view of a generally rectangular or square lavatory setter according to the invention;

FIG. 4 is a top view of an oval lavatory setter according to the invention; and FIG. 5 is a partial cross sectional view of another embodiment of a lavatory setter according to the invention wherein an inner wall has an inclined inner surface for supportingly engaging an outer surface portion of the bowl adjoining the rim portion of the lavatory.

DESCRIPTION OF THE PREFERRED EMBODIMENT(S)

In FIGS. 1 and 2 there is shown, for example, a circular hollow lavatory setter 10 adapted for supportingly engaging a circular pheripheral rim portion of a circular rimless lavatory L shown in phantom lines. The hollow setter 10 has in this instance a continuous annular refractory wall of generally rectangular cross sectional shape about 1¼" (3.17 cm) thick or high×3" (7.62 cm) wide, a wall thickness of about ¼" (6.35 mm), an outer peripheral wall or surface 14 of about 20½" (52 cm) in diameter and an inner pheripheral wall or surface 16 about 14½" (36.83 cm) in diameter extending around a similarly sized central bowl receiving opening 18.

A ¾" (19 mm)×3" (3.17 cm) wide casting sprue opening 20 in the outside wall 14 interconnects with the annular hollow core opening or passage 22 for the purpose of slip casting the setter ring and removal of excess material therefrom. Preferably, the sprue is cut or ground off at the outer surface as shown.

The outer and inner walls 14 and 16 extend axially to opposite upper and lower convex corners of about ⅜" (9.5 mm) radius connected to upper and lower smooth flat and parallel horizontal walls or surfaces 24 and 26 respectively.

As shown in phantom lines the setter is normally elevated whereby the lower surface 26 rests upon a plurality of suitable refractory supports, pillars, or stacks of refractory blocks S extending upwardly a sufficient distance from the insulating refractory support base B of a kiln car. Suitable refractory supports or blocks S and base B may be of alumina, silicon carbide, recrystallized silicon carbide, zirconia, or mixtures thereof.

During the first part of a firing cycle the upper inner convex corner surface of the inner wall 16 supportingly engages the adjacent outer convex surface C of the lavatory bowl which continually shrinks and allows the under mounting surface of the lavatory rim portion R to gradually move down into supporting mating engagement with the upper surface 24 during the remaining latter and final portion of the firing cycle and cooling thereof.

Another hollow rectangular lavatory setter 10' according to the invention adapted for setting and firing a rectangular rimless lavatory is shown in FIG. 3. The rectangular setter 10' has a continuous refractory wall 12' of substantially the same rectangular cross sectional shape and size as setter 10' including outer and inner walls or surfaces 14' and 16', a rectangular bowl receiving opening 18', a casting sprue opening 20' to a hollow core rectangular passage 22', smooth flat parallel upper and lower walls or surfaces 24' and 26' and convex corners.

A square shape hollow setter (not shown) could also be provided with a square bowl receiving opening and a continuous wall of identical rectangular cross sectional shape and size as the rectangular setter 10' for firing a square rimless lavatory.

Another hollow oval shape setter 10'' is shown in FIG. 4 for supportingly engaging an oval rimless lavatory during firing in a kiln. The oval setter 10'' likewise has a continuous wall 12'' of substantially the same rectangular cross sectional shape and size as the setter 10 including outer and inner walls or surfaces 14'' and 16'', an oval bowl receiving opening 18'', a sprue opening 20'' connected to an oval core passage 22'', smooth flat and parallel upper and lower surfaces 24'' and 26'' and convex corners.

A further embodiment of the invention is partially shown in FIG. 5 wherein a similar slightly modified hollow lavatory setter 10''' has a continuous wall 12''' of generally rectangular cross sectional shape, an outer wall 14''' and an inner wall 16''' including an inner inclined surface inclined about 10° extending between the inner convex corners of the upper and lower walls or surfaces 24''' and 26'''.

As shown, the inner inclined surface of the inner wall 16''' extends around the bowl openng 18''', makes line or narrow band contact with and supportingly engages at least portions of the outer convex surface of the bowl adjoining the rim portion of the lavatory during at least the initial setting, partial firing and shrinkage of a green lavatory and until the initially raised under mounting surface of the rim portion R''' comes in contact with the upper surface 24'''.

In FIGS. 1 and 5 the initial raised and final positions of the lavatories L and L''' are shown in phantom lines. When placed on the setters the rim portions R and R''' are initially maintained normally about 1" (2.54 cm) above the final upper supporting surface 24 and 24''' of the setters 10 and 10''' and the adjacent convex surface C and C''' of the bowl is in sole supporting engagement with the inner upper convex corner surface (FIG. 1) and the inclined surface (FIG. 5) of the respective inner walls 16 and 16'''.

As the temperature in the kiln increases the green lavatory begins to soften and shrink, whereupon during a portion of the firing cycle the engaging convex surface of the bowl slides downwardly on the sole supporting convex corner and the inner inclined surfaces of the respective inner walls 16 and 16'''. Upon sufficient shrinkage the under mounting surface of the rim comes into mating engagement with and is supported by the upper surfaces 24 and 24''' of the respective setters 10 and 10''' for the remaining and final portion of the firing and cooling cycles.

All of the hollow refractory lavatory setters according to the invention are preferably of recrystallized silicon carbide made by slip casting a suitable silicon carbide material in plaster molds of the desired configuration and firing to recrystallize the silicon carbide in the manner taught in U.S. Pat. No. 2,964,823 and to which reference maybe had for detail not disclosed herein.

However, the rimless lavatory setters of the invention can also be made of other suitable refractory material such as alumina, zirconia, silicon carbide, and mixtures thereof which can also be molded or slip cast and fired in the well known manner.

As many other embodiments of the invention are possible it is to be understood the embodiments disclosed hereinabove are for illustrative purposes only and that the invention includes all modifications and equivalents thereof falling within the scope of the appended claims.

We claim:

1. A refractory lavatory setter for supportingly engaging a mounting under surface of a peripheral mounting rim portion of predetermined configuration and size extending around adjacent an outer convex surface of a bowl of a rimless lavatory during firing thereof in a kiln comprising:

a continuous hollow integral slip case and fired refractory wall of predetermined cross sectional size and shape extending continuously around a bowl receiving opening of prescribed size and shape therein and having an inner wall portion and inner surface adjoining and defining the size and shape of the bowl receiving opening and having at least an inwardly and downwardly extending surface portion thereof adapted to at least initially supportingly and slideably engage the outer convex surface of the bowl, and maintain the rim portion spaced from the setter during a first part of the firing cycle, shrinkage and gradual downward movement of the lavatory, an outer wall portion and outer surface spaced from and extending around the inner wall portion and of substantially the predetermined configuration of the peripheral mounting rim portion of the lavatory, a lower wall portion and lower surface, engageable by support means for maintaining the setter and lavatory thereon in and elevated position during firing extending between and integrally connected to opposite lower inner and outer portions of the inner and outer wall portions and surfaces, and an upper wall portion spaced from the lower wall portion and extending between and integrally connected to opposite upper inner and outer portions of the inner and outer wall portions and having a continuous upper surface adapted for continuous mating supporting engagement with and maintaining the mounting under surface of the peripheral mounting rim portion substantially in a single plane during firing thereof in the kiln.

2. A refractory lavatory setter according to claim 1 wherein the continuous upper surface of the upper wall is substantially flat, smooth, and situated in a single plane.

3. A refractory lavatory setter according to claim 1 wherein the continuous hollow integral refractory wall has a substantially rectangular cross sectional shape including integral upper and lower corner portions with convex surfaces joining the inner and outer wall portions and surfaces to the upper and lower wall portions and surfaces.

4. A refractory lavatory setter according to claim 1 wherein the inwardly and downwardly extending surface portion comprises:

an upper inner corner portion including a convex corner surface integrally connected to the inner and upper wall portions and surfaces and adapted to supportingly engage a convex surface portion of the bowl adjacent the mounting under surface of the peripheral mounting rim portion of the rimless lavatory.

5. A refractory lavatory setter according to claim 1 wherein the inwardly and downwardly extending surface portion of the inner surface of the inner wall is inclined inwardly from the upper surface and toward a center of the bowl receiving opening.

6. A refractory lavatory setter according to claim 1 wherein the upper and lower surfaces are flat, smooth, and substantially parallel.

7. A refractory lavatory setter according to claim 1 wherein the inner and upper surfaces are adapted for supporting a substantially circular rimless lavatory.

8. A refractory lavatory setter according to claim 1 wherein the inner and upper surfaces are adapted for supporting a substantially oval rimless lavatory.

9. A refractory lavatory setter according to claim 1 wherein the inner and upper surfaces are adapted for supporting a substantially polygonal rimless lavatory.

10. A refractory lavatory setter according to claim 1 wherein the inner and upper surfaces are adapted for supporting a rectangular rimless lavatory.

11. A refractory lavatory setter according to claim 1 wherein the continuous hollow integral refractory wall is made of recrystallized silicon carbide.

* * * * *